US009821970B2

(12) United States Patent
Arai

(10) Patent No.: US 9,821,970 B2
(45) Date of Patent: Nov. 21, 2017

(54) SHEET FEEDER AND IMAGE FORMING SYSTEM

(71) Applicant: BROTHER KOGYO KABUSHIKI KAISHA, Nagoya, Aichi (JP)

(72) Inventor: Yusuke Arai, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 15/175,146

(22) Filed: Jun. 7, 2016

(65) Prior Publication Data

US 2016/0355361 A1 Dec. 8, 2016

(30) Foreign Application Priority Data

Jun. 8, 2015 (JP) ..... 2015-115870

(51) Int. Cl.
*B65H 7/02* (2006.01)
*B65H 3/06* (2006.01)
*B65H 3/56* (2006.01)

(52) U.S. Cl.
CPC ..... *B65H 3/0669* (2013.01); *B65H 3/0684* (2013.01); *B65H 3/56* (2013.01); *B65H 7/02* (2013.01); *B65H 2511/152* (2013.01); *B65H 2511/214* (2013.01); *B65H 2511/30* (2013.01); *B65H 2513/11* (2013.01); *B65H 2513/53* (2013.01); *B65H 2557/23* (2013.01); *B65H 2801/12* (2013.01)

(58) Field of Classification Search
CPC ..... B65H 7/04; B65H 7/20; B65H 2301/423245; B65H 7/00; B65H 2301/423
See application file for complete search history.

(56) References Cited

U.S. PATENT DOCUMENTS

| | | | | |
|---|---|---|---|---|
| 6,227,534 | B1 * | 5/2001 | Schoedinger | B65H 3/0669 271/110 |
| 8,246,042 | B2 * | 8/2012 | Gagnon | B65H 3/0684 271/117 |
| 8,561,978 | B2 * | 10/2013 | Takahashi | B65H 7/18 271/3.01 |
| 2009/0110410 | A1 * | 4/2009 | Gettelfinger | B65H 3/0684 399/16 |

FOREIGN PATENT DOCUMENTS

| | | |
|---|---|---|
| JP | 2000-053269 A | 2/2000 |
| JP | 2001-220028 A | 8/2001 |
| JP | 2009-007144 A | 1/2009 |
| JP | 2009-035348 A | 2/2009 |

* cited by examiner

*Primary Examiner* — Howard Sanders
(74) *Attorney, Agent, or Firm* — Scully, Scott, Murphy & Presser, P.C.

(57) ABSTRACT

A sheet feeder including a tray, a feeder roller, a guide, a separator, a motor, a controller, and a sensor, is provided. The sheet feeder separates an object sheet from other sheets in the tray and feed the object sheet through the guide and the separator by rotation of the feeder roller. The controller determines a remaining volume of the sheets in the tray based on a signal from the sensor; generate a velocity profile so that the object sheet is fed at a lower velocity in an earlier first period than a velocity in a later second period; based on the determined remaining volume of the plurality of sheets, modify at least one of a length of the first period and the target velocity in the first period of the velocity profile; and after modification of the velocity profile, control the motor in compliance with the modified velocity profile.

8 Claims, 7 Drawing Sheets

SHEET FEEDER AND IMAGE FORMING SYSTEM

CROSS-REFERENCE TO RELATED APPLICATION

This application claims priority under 35 U.S.C. §119 from Japanese Patent Application No. 2015-115870 filed on Jun. 8, 2015. The entire subject matter of the application is incorporated herein by reference.

BACKGROUND

Technical Field

The following description relates to an aspect of a sheet feeder and an image forming system.

Related Art

A sheet feeder capable of conveying sheets stacked on a tray one-by-one downstream along a predetermined path is known. The sheet feeder may be included in, for example, an image forming system. Further, a sheet feeder equipped with a separator to separate sheets on a guiding surface, which adjoins the tray, is known. The sheet feeder with the separator may separate one of the sheets being an object sheet for conveyance from the other sheets when the sheets are conveyed to pass over the guiding surface so that solely the separated object sheet should be conveyed downstream. Furthermore, a sheet feeder capable of controlling timings to start feeding the sheets depending on a height of the sheets stacked on the tray so that an interval between the sheets to be successively conveyed may be controlled.

SUMMARY

In order to separate the object sheet from the other sheets stacked on the tray correctly, it may be preferable that the object sheet is conveyed at a lower velocity on the separator. Meanwhile, however, if the object sheet is conveyed at a lower velocity, conveyance of the object sheet to a downstream aimed position may take longer time.

An aspect of the present disclosure is advantageous in that a technique to separate an object sheet from other sheets stacked on a tray correctly and restrain time to convey the object sheet to an aimed position from being lengthened is provided.

According to an aspect of the present disclosure, a sheet feeder is provided. The sheet feeder includes a tray; a feeder roller configured to contact an object sheet being a topmost one of the plurality of sheets in the stack in the tray to feed the object sheet in a feeding direction by rotating; a guide disposed downstream of the feeder roller in the feeding direction to adjoin the tray, the guide comprising a guiding surface extending from a bottom of the tray in a predetermined direction, the predetermined direction containing a direction of the sheets to be stacked in the tray and the feeding direction, and the guiding surface being arranged to incline at an obtuse angle with respect to the object sheet fed to contact the guiding surface by the feeder roller; a separator arranged on the guide to protrude from the guiding surface toward a space in the tray to accommodate the plurality of sheets to align with the predetermined direction, the separator being configured to separate the object sheet fed by the rotation of the feeder roller from the other of the plurality of sheets; a motor configured to drive the feeder roller to rotate; a controller configured to control the motor; and a sensor configured to input a signal corresponding to a remaining volume of the plurality of sheets in the tray to the controller. The controller is configured to, based on the signal input by the sensor, determine the remaining volume of the plurality of sheets in the tray; generate a velocity profile defining a target velocity to feed the topmost sheet from a start to an end of a sheet-feeding operation, so that the topmost sheet is fed at a lower velocity in a first period than a velocity in a second period, the second period being later than the first period, in the sheet-feeding operation; based on the determined remaining volume of the plurality of sheets, modify at least one of a length of the first period and the target velocity in the first period of the velocity profile; and after a modification of the velocity profile, control the motor in compliance with the modified velocity profile.

According to another aspect of the present disclosure, an image forming system including a sheet feeder and an image forming apparatus is provided. The sheet feeder includes a tray; a feeder roller configured to contact an object sheet being a topmost one of the plurality of sheets in the stack in the tray to feed the object sheet in a feeding direction by rotating; a guide disposed downstream of the feeder roller in the feeding direction to adjoin the tray, the guide comprising a guiding surface extending from a bottom of the tray in a predetermined direction, the predetermined direction containing a direction of the sheets to be stacked in the tray and the feeding direction, and the guiding surface being arranged to incline at an obtuse angle with respect to the object sheet fed to contact the guiding surface by the feeder roller; a separator arranged on the guide to protrude from the guiding surface toward a space in the tray to accommodate the plurality of sheets to align with the predetermined direction, the separator being configured to separate the object sheet fed by the rotation of the feeder roller from the other of the plurality of sheets; a motor configured to drive the feeder roller to rotate; a controller configured to control the motor; and a sensor configured to input a signal corresponding to a remaining volume of the plurality of sheets in the tray to the controller. The image forming apparatus is configured to form an image on the object sheet fed by the sheet feeder. The controller of the sheet feeder is configured to, based on the signal input by the sensor, determine the remaining volume of the plurality of sheets in the tray; generate a velocity profile defining a target velocity to feed the object sheet from a start to an end of a sheet-feeding operation, so that the object sheet is fed at a lower velocity in a first period than a velocity in a second period, the second period being later than the first period, in the sheet-feeding operation; based on the determined remaining volume of the plurality of sheets, modify at least one of a length of the first period and the target velocity in the first period of the velocity profile; and after a modification of the velocity profile, control the motor in compliance with the modified velocity profile.

According to still another aspect of the present disclosure, a method adapted to be implemented on a controller coupled with a sheet feeder is provided. The method includes, based on a signal input to the controller by a sensor of the sheet feeder, determining a remaining volume of a plurality of sheets stacked in a tray of the sheet feeder; generating a velocity profile defining a target velocity to feed a topmost sheet which is one of the plurality of sheets stacked in the tray from a start to an end of a sheet-feeding operation, so that the topmost sheet is fed at a lower velocity in a first period than a velocity in a second period, the second period being later than the first period, in the sheet-feeding operation; based on the determined remaining volume, modifying at least one of a length of the first period and the target velocity in the first period of the velocity profile; and after a modification of the velocity profile, controlling a motor in the sheet feeder in compliance with the modified velocity profile.

BRIEF DESCRIPTION OF THE ACCOMPANYING DRAWINGS

DETAILED DESCRIPTION

Hereinafter, illustrative embodiments according to aspects of the present disclosure will be described with reference to the accompanying drawings.

It should be noted that various connections may be set forth between elements in the following description. These connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to random access memories (RAMs), read-only memories (ROMs), flash memories, electrically erasable programmable ROMs (EEPROMs), CD-media, DVD-media, temporary storage, hard disk drives, floppy drives, permanent storage, and the like.

First Embodiment

Figure 1:
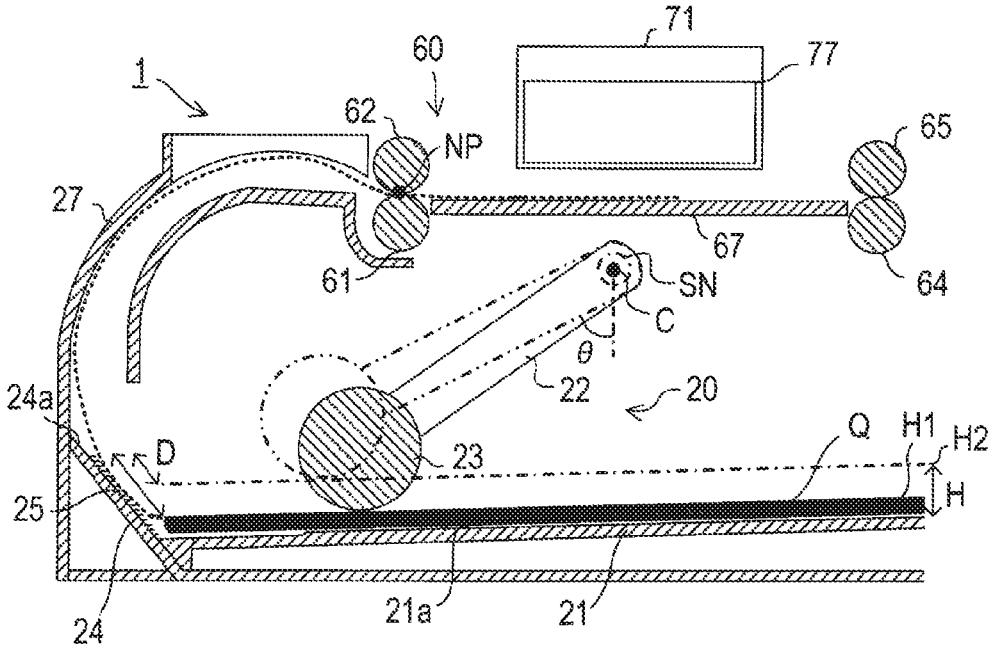
FIG. 1 is an illustrative cross-sectional view of a sheet feeder and a sheet conveyer according to an embodiment of the present disclosure.

An image forming system 1 shown in FIG. 1 may include an inkjet printer. The image forming system 1 may separate sheets Q stored in a feeder tray 21 from one another and convey the separated sheets one-by-one downstream in a conveyer path. The image forming system 1 may form images on the sheets Q passing through an area below an inkjet head 7.

The image forming system 1 includes a sheet feeder 20 and a sheet conveyer 60 to convey the sheets Q. The sheet feeder 20 includes the feeder tray 21, an arm 22, a feeder roller 23, a guide 24, and a separator 25. The sheets Q may be stacked in layers on the feeder tray 21. The sheet feeder 20 may convey the sheets Q from the feeder tray 21 in a conveying direction by rotating the feeder roller 23.

The arm 22 is rotatable about an axis C, which is at one longitudinal end of the arm 22, and supports the feeder roller 23 rotatably at the other longitudinal end. The arm 22 may apply pressure to a topmost one of the sheets Q, which is an object sheet for conveyance, by the effect of gravity or by an urging force of a spring. The sheet Q being the object sheet that contacts the feeder roller 23 may be moved by rotation of the feeder roller 23 to be conveyed from the feeder tray 21 in the conveying direction to pass over the guide 24 and the separator 25 arranged on the guide 24 to a U-turn path 27. A course of the sheet Q, which is for example shown in a broken line in FIG. 1, may be restricted in the U-turn path 27 so that the sheet Q may be guided to a nipping position NP between a paper feed (PF) roller 61 and a pinch roller 62.

The guide 24 is arranged in a downstream and adjoining position from the feeder tray 21 with regard to the conveying direction, along which the sheet Q is conveyed by the feeder roller 23. A guiding surface 24*a* of the guide 24 may guide the object sheet Q, which is conveyed by the rotation of the feeder roller 23 in the conveying direction, to the U-turn path 27. The guiding surface 24*a* is extended to incline with respect to a bottom surface 21*a* of the feeder tray 21 toward the U-turn path 27. Specifically, the guiding surface 24*a* may extend to incline in a predetermined direction, which contains direction components of a stacking direction of the sheets Q and the conveying direction. The guide 24 is disposed in such an inclined arrangement that the object sheet Q conveyed from the feeder tray 21 should contact the guiding surface 24*a* at an obtuse angle.

The separator 25 may separate the topmost sheet Q being the object sheet, which is to be conveyed by the rotation of the feeder roller 23 in the conveying direction, from the other sheets Q in a lower layer in the feeder tray 21. The separator 25 may include a plurality of metal pieces, which align with the predetermined direction to protrude from the guiding surface 24*a* toward a part of the feeder tray 21 that may accommodate the sheets Q. The separator 25 may not necessarily include the metal pieces but may include, for example, pieces in another material that may cause higher friction resistance in the sheet Q being conveyed from the feeder tray 21. Optionally, the separator 25 may be formed integrally with the guide 24. For example, the guide 24 may have the guiding surface 24*a*, on which a plurality of protrusions being the separator 25 are formed. The guide 24 having the separator 25 may or may not be formed integrally with the feeder tray 21. If the guide 24 having the separator 25 is formed separately from the feeder tray 21, the guide 24 may be fixed to a chassis of the image forming system 1.

The sheet conveyer 60 may convey the sheet Q reaching the nipping position NP further downstream to an area underneath the inkjet head 77. The sheet conveyer 60 includes the PF roller 61, the pinch roller 62, a discharge roller 64, and a spur roller 65. The pinch roller 62 is arranged to face the PF roller 61, and the spur roller 65 is arranged to face the discharge roller 64. The discharge roller 64 may convey the sheet Q having been conveyed by the PF roller 61 further downstream. In a position between the PF roller 61 and the discharge roller 64, arranged is a platen 67, which may support the sheet Q being conveyed from the PF roller 61 to the discharge roller 64 from below.

The sheet Q conveyed from the sheet feeder 20 to the nipping position NP may be nipped therein by the PF roller 61 and the pinch roller 62 and conveyed downward by rotation of the PF roller 61. The sheet Q reaching the discharge roller 64 may enter a position between the discharge roller 34 and the spur roller 65 and may be conveyed downstream by rotation of the discharge roller 64. The sheet Q conveyed downstream by the discharge roller 64 may be discharged and placed in a discharge tray, which is not shown.

The inkjet head 77 is mounted on a carriage 71 and is disposed in a position above the platen 67 to face the platen 67. The inkjet head 77 is driven together with the carriage 71 to reciprocate in a main scanning direction, e.g., a normal direction in FIG. 1, which is orthogonal to the conveying direction. The inkjet head 77 may discharge ink droplets downward, while the inkjet head 77 reciprocates, to form an image on the sheet Q passing over the platen 67.

Figure 2:
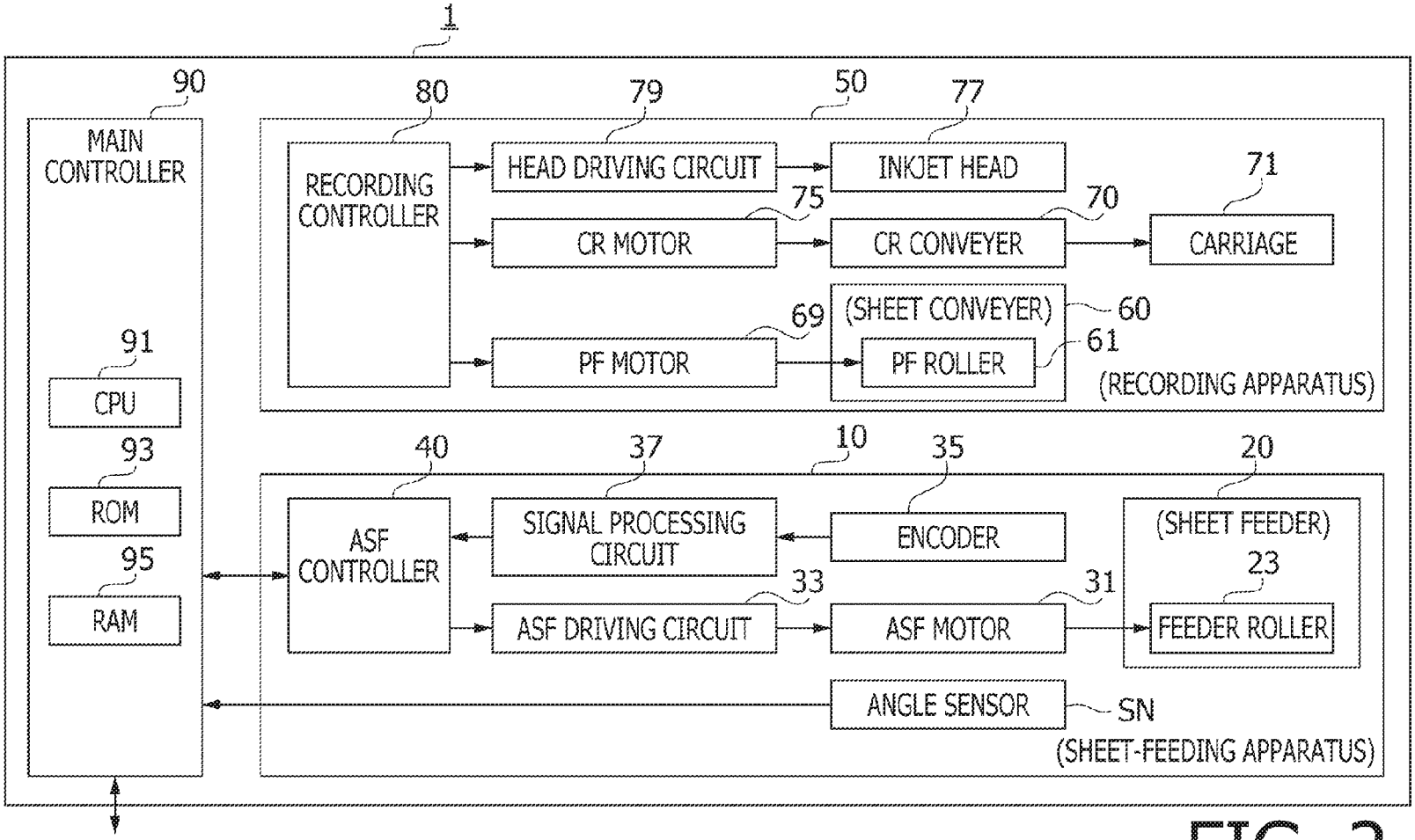
FIG. 2 is a block diagram to illustrate an overall configuration of an image forming system according to the first embodiment of the present disclosure.

Specifically, as shown in FIG. 2, the image forming system 1 includes a sheet-feeding apparatus 10, a recording apparatus 50, and a main controller 90. The sheet-feeding apparatus 10 includes the sheet feeder 20, an auto-sheet feeder (ASF) motor 31, an ASF driving circuit 33, a rotary encoder 35, a signal processing circuit 37, an ASF controller 40, and an angle sensor SN.

The ASF motor 31 is a direct-current motor to drive the feeder roller 23 to rotate and is activated by the ASF driving circuit 33. The ASF driving circuit 33 activates the ASF motor 31 by applying a driving current according to an operation amount (a current command value) U input to the ASF motor 31.

The rotary encoder 35 is arranged coaxially with a rotation axis of the feeder roller 23 or with a rotation axis of the ASF motor 31 to output pulse signals corresponding to the rotation of the feeder roller 23 or the ASF motor 31. The signal processing circuit 37 measures a rotation amount X and a rotation velocity V of the feeder roller 23 or the ASF motor 31. The rotation amount X of the feeder roller 23 and the rotation amount X of the ASF motor 31 are in proportional relation with each other, and the rotation velocity V of the feeder roller 23 and the rotation velocity V of the ASF motor 31 are in proportional relation with each other; therefore, either one of the rotation amounts X of the feeder roller 23 and the ASF motor 31 may be measured, and either one of the rotation velocities V of the feeder roller 23 and the ASF motor 31 may be measured. In the following description, the rotation amount X will refer to a rotation amount per unit of time from a start to an end of a sheet-feeding operation. The rotation amount X and the rotation velocity V may indirectly indicate an amount of displacement and a velocity of displacement for the sheet Q. Further, in the following description, for the purpose of illustration, it may be assumed that the signal processing circuit 37 measures the rotation amount X and the rotation velocity V of the ASF motor 31.

The ASF controller 40 may calculate the operation amount U for the ASF motor 31 according to a command from the main controller 90 and inputs the calculated value to the ASF driving circuit 33. Thus, the ASF controller 40 may control the rotation of the ASF motor 31 by calculating the operation amount U and inputting the calculated result.

The angle sensor SN is arranged in the vicinity of a rotation shaft C of the arm 22. The angle sensor SN may detect an angle Θ of the arm 22 with respect to a reference line and input a signal corresponding to the detected angle Θ to the main controller 90. In the following description, the angle Θ detected by the angle sensor SN may be referred to as an arm angle Θ. Information concerning the arm angle Θ may be used by the main controller 90 to achieve a height H of a stack of the sheets Q remaining in the feeder tray 21. The angle Θ shown in FIG. 1 corresponds to an angle of the feeder roller 23 when the height H of the sheets Q is at H1. Double-dotted lines in FIG. 1 illustrate a condition of the arm 22 when the height H of the sheets Q is at H2, which is different from H1. As seen in the double-dotted lines, the arm angle Θ should vary according to the height H of the sheets Q.

Meanwhile, the recording apparatus 50 includes the sheet conveyer 60, the carriage 71, and the inkjet head 77, which are mentioned above, and further includes a paper feed (PF) motor 69, a carriage (CR) conveyer 70, a CR motor 75, a head driving circuit 79, and a recording controller 80. The recording apparatus 50 may include a motor driving circuit, an encoder, and a signal processing circuit; however, description of those are herein omitted.

The PF motor 69 is a direct-current motor to drive the PF roller 61 in the sheet conveyer 60 to rotate. The PF motor 69 is controlled by the recording controller 80 through a driving circuit, which is not shown. The PF roller 61 and the discharge roller 64 are coupled to each other through a belt mechanism, which is not shown, so that the discharge roller 64 should rotate synchronously with the PF roller 61.

The CR conveyer 70 is driven by a driving force from the CR motor 75 to reciprocate the carriage 71 along with the inkjet head 77 in the main scanning direction. The CR motor 75 is a direct-current motor to apply the driving force to the CR conveyer 70 and is controlled by the recording controller 80 through a driving circuit, which is not shown.

The head driving circuit 79 drives the inkjet head 77 to eject the ink droplets therefrom. Thus, ejection of the ink droplets from the inkjet head 77 is controlled by the recording controller 80 through the head driving circuit 79. The recording controller 80 may control a conveying operation to convey the sheet Q to the position below the inkjet head 77 and an image forming operation to form an image on the sheet Q by controlling the PF motor 69, the CR motor 75, and the head driving circuit 79 according to the command from the main controller 90.

The main controller 90 includes a central processing unit (CPU) 91, a read-only memory (ROM) 93, and a random-access memory (RAM) 95 and controls behaviors of the image forming system 1. The CPU 91 may execute various types of processes according to programs stored in the ROM 93. The RAM 95 may be used as a work area for the CPU 91 to execute the processes.

The CPU 91 in the main controller 90, in response to receipt of printable data transmitted from an external device (not shown), inputs commands to the sheet-feeding apparatus 10 and the recording apparatus 50 so that an image based on the printable data may be formed on the sheet Q. In the following description, the processes and operations undertaken by the CPU 91, which include a print controlling process (see FIG. 3) and a sheet-feeding process (see FIG. 4), may be described as processes and operations to be executed by the main controller 90.

Figure 3:
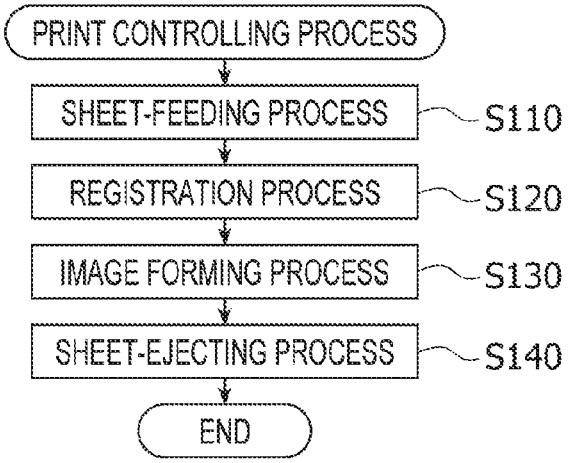
FIG. 3 is a flowchart to illustrate a flow of steps in a print controlling process to be executed by a main controller in the image forming system according to the first embodiment of the present disclosure.

The main controller 90 executes the print controlling process shown in FIG. 3 in response to receipt of the printable data. In the print controlling process, in S110, the main controller 90 conducts a sheet-feeding process. In the sheet-feeding process in S110, the main controller 90 inputs a command to the sheet-feeding apparatus 10 so that the sheet Q should be separated from the sheet stack on the feeder tray 21 and conveyed to the nipping position NP between the PF roller 61 and the pinch roller 62.

Following S110, in S120, the main controller 90 conducts a registration process. In the registration process, the main controller 90 inputs a command to the recording apparatus 50 so that the sheet Q conveyed to the nipping position NP should be conveyed further downstream. According to the command, the recording apparatus 50 manipulates the PF roller 61 to rotate until a leading end of an image forming area on the sheet Q reaches an image forming position, on which an ejected ink droplet should land.

Following the registration process in S120, in S130, the main controller 90 conducts an image forming process. In the image forming process, the main controller 90 controls the recording apparatus 50 to repetitively form a part of the image that may be formed by the inkjet head 77 moving in the main scanning direction and convey the sheet for a distance corresponding to the part until an entire image is completed. Following S130, in S140, the main controller 90 conducts a sheet-ejecting process. In the sheet-ejecting process, the main controller 90 manipulates the recording apparatus 50 to eject the sheet Q, on which the image is completed, to the ejection tray.

Thus, the main controller 90 forms the image based on the printable data transmitted from the external device on the sheet Q to output the image by executing the sheet-feeding process (S110), the registration process (S120), the image forming process (S130), and the sheet-ejecting process (140).

Figure 4:
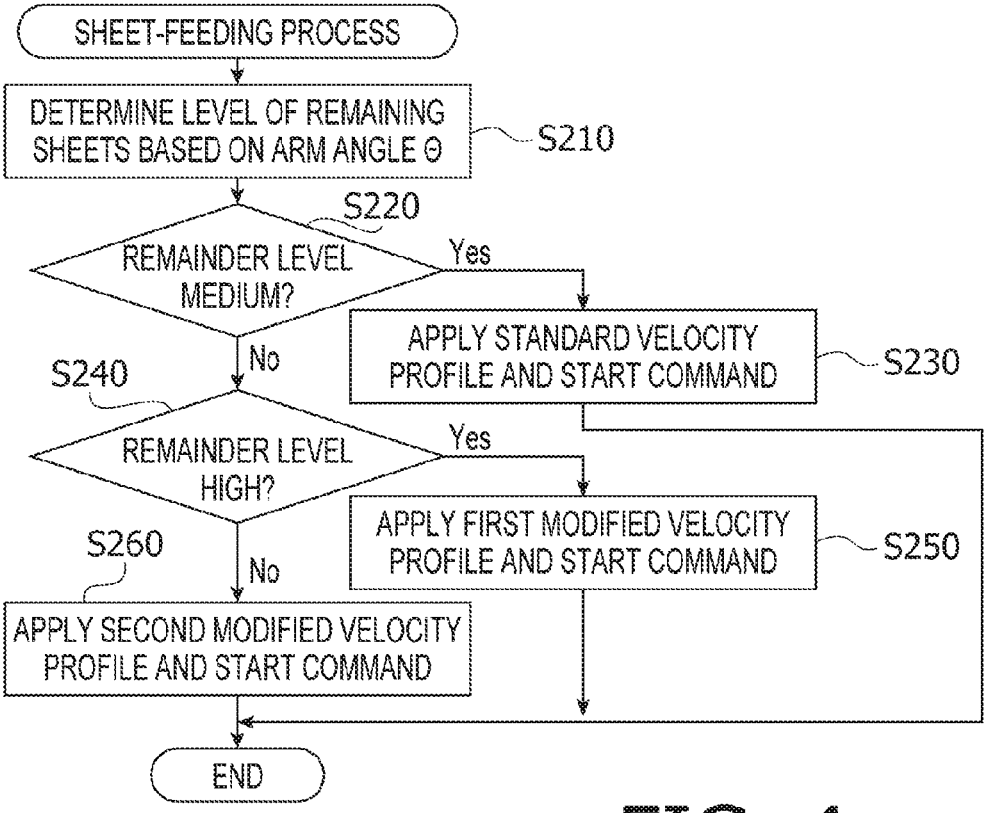
FIG. 4 is a flowchart to illustrate a flow of steps in a sheet-feeding process to be executed by the main controller in the image forming system according to the first embodiment of the present disclosure.

Next, the sheet-feeding process in S110 mentioned above will be described in detail with reference to FIG. 4. In the sheet-feeding process, in S210, based on the arm angle Θ indicated by the signal from the angle sensor SN, the main controller 90 calculates the height H of the stack of the sheets Q corresponding to the arm angle Θ. The height H may be obtained by installing a function, in which the height H may be calculated based on the geometrically-determinable arm angle Θ, into the program to be run in the sheet-feeding process.

The main controller 90 may determine a volume level of the remaining sheets Q depending on the calculated height H. That is, based on the height H being smaller than a first threshold value Th1, the main controller 90 determines the volume level of the remaining sheets Q to be "low." Based on the height H being greater than or equal to the first threshold value Th1 and smaller than a second threshold value Th2, the main controller 90 determines the volume level of the remaining sheets Q to be "medium." Based on the height H being greater than or equal to the second threshold Th2, the main controller 90 determines the volume level of the remaining sheets Q to be "high." Alternatively, in S210, the main controller 90 may determine the volume level of the remaining sheets Q, without calculating the height H, based on comparison between the arm angle Θ and the thresholds.

In S220, based on affirmative determination that the volume level of the remaining sheets Q is "medium" (S220: YES), in S230, the main controller 90 applies a standard velocity profile to the ASF controller 40 and inputs a command to the ASF controller 40 to start controlling the ASF motor 31 in compliance with the applied velocity profile. Thereafter, the main controller 90 ends the sheet-feeding process.

Figure 5A:
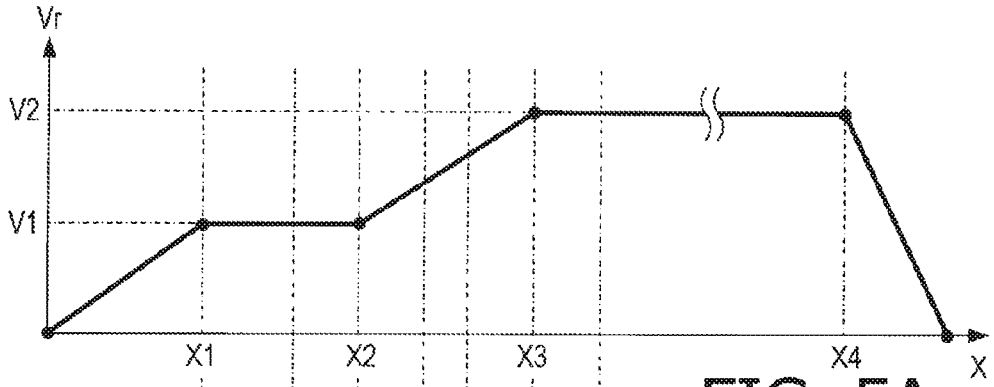
FIGS. 5A-5C are graphs to illustrate velocity profiles for each volume level of remaining sheets in the image forming system according to the first embodiment of the present disclosure.

The velocity profile is a unit of data, defining transition of a target velocity Vr being a velocity V to convey the sheet Q from the feeder tray 21 from the start of the sheet-feeding operation, which is the timing when the sheet Q starts being conveyed from the sheet feeder tray 21. The standard velocity profile shown in FIG. 5A indicates correspondence between the rotation amount X of the ASF motor 31 and the target velocity Vr. As seen in FIG. 5A, the standard velocity profile defines a period, wherein a rotation amount X1 (X=X1) shifts to a rotation amount X2 (X=X2), to be a first constant velocity period, and another period, wherein a rotation amount X3 (X=X3) shifts to a rotation amount X4 (X=X4), to be a second constant velocity period. A target velocity V1 being the target velocity Vr in the first constant velocity period is set to be a velocity V, at which the object sheet Q should be preferably separated from the other sheets Q in the lower layer by the separator 25. A target velocity V2 being the target velocity Vr in the second constant velocity period may be a highest velocity for the ASF motor 31 within a capability at which the sheet Q may be steadily conveyed. Therefore, the target velocity V1 in the first constant velocity period is lower than the target velocity V2 in the second constant velocity period.

The rotation amount X1 is a rotation amount X required for the ASF motor 31 accelerating to reach the target velocity V1 to enter the first constant velocity period. The rotation amount X2 is a rotation amount X corresponding to a distance D (see FIG. 1) for the leading end of the sheet Q to travel along the guiding surface 24*a* arranged on the separator 25 when the volume level of the remaining sheets Q is medium. Specifically, the rotation amount X2 is a rotation amount X corresponding to the distance D for the leading end of the sheet Q to travel along the guiding surface 24*a* when the volume level of the remaining sheets Q is at a lowest position within a range of the "medium" level: in other words, when the object sheet Q to be conveyed is at a height H closest to the sheets Q in the "low" level. The rotation amount X3 is a rotation amount X required for the ASF motor 31 accelerating from the velocity V1 to reach the velocity V2 and is defined by a value added to the rotation amount X2. The rotation amount X4 is set at a point corresponding to a distance required for the ASF motor 31 reducing the velocity to stop rotating.

Figure 6:
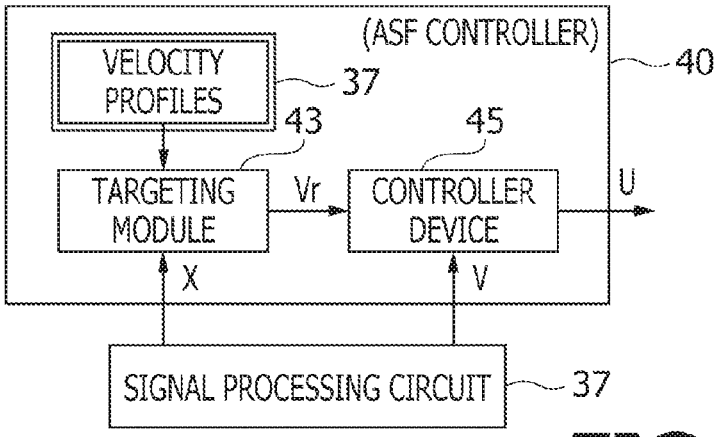
FIG. 6 is a block diagram to illustrate a configuration of an auto-sheet feeder (ASF) controller in the image forming system according to the first embodiment of the present disclosure.

The ASF controller 40 includes, as shown in FIG. 6, a register 41 to store preset values for the velocity profiles, a targeting module 43, and a controller device 45. The rotation amount X of the ASF motor 31 measured by the signal processing circuit 37 is input in the targeting module 43, and according to the command from the main controller 90, the targeting module 43 inputs the target velocity Vr corresponding to the rotation amount X of the ASF motor 31 from the signal processing circuit 37 to the controller device 45 in compliance with the velocity profile set in the register 41. The controller device 45 calculates an operation amount (current command value) U based on deviation between the target velocity Vr input from the targeting module 43 and the velocity V measured by the signal processing circuit 37 and inputs the calculated operation amount U to the ASF driving circuit 33. The ASF driving circuit 33 drives the ASF motor 31 by applying the driving current according to the operation amount U input from the controller device 45.

While the velocity profile illustrated in FIG. 5A is set in the ASF controller 40, the ASF motor 31 is controlled to accelerate, from the starting point of the sheet-feeding operation, in which the velocity V is zero (V=0), and until the rotation amount X reaches the rotation amount X1, so that the velocity V reaches the target velocity V1 at the rotation amount X1. The ASF motor 31 is controlled to rotate at the constant velocity V1 within a period, wherein the rotation amount X shifts from the rotation amount X1 to the rotation amount X2. The ASF motor 31 is controlled by the ASF controller 40 to accelerate to the target velocity V2 at the rotation amount X3 within a period, wherein the rotation amount X shifts from the rotation amount X2 to the rotation amount X3. The ASF motor 31 is controlled by the ASF controller 40 to rotate at the constant velocity V2 within the period, wherein the rotation amount X shifts from the rotation amount X3 to the rotation amount X4. When the rotation amount X reaches the rotation amount X4, the ASF motor 31 is controlled by the ASF controller 40 to reduce the rotation and to stop.

Based on determinations in S210 and S240 that the volume level of the remaining sheets Q is not "medium" (S220: NO) but "high" (S240: YES), the main controller 90 proceeds to S250. In S250, the main controller 90 applies a first modified velocity profile, which is a velocity profile designed for the volume level "high" of the remaining sheets Q, to the ASF controller 40. Further, in S250, the main controller 90 inputs a command to start controlling the ASF motor 31 in compliance with the applied velocity profile. The main controller 90 ends the sheet-feeding process (S110) thereafter.

Figure 5B:
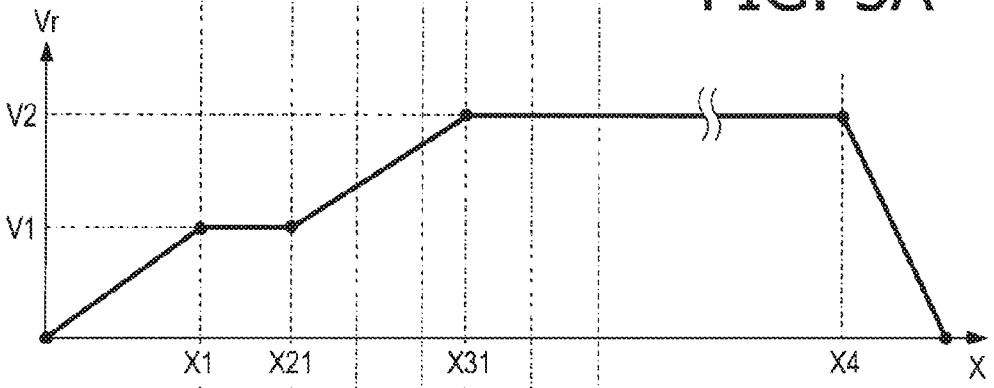

The first modified velocity profile illustrated in FIG. 5B is a velocity profile, in which the rotation amount X at the end of the first constant velocity period is modified from the rotation amount X2 in the standard velocity profile to a rotation amount X21. Further, according to the modification of the rotation amount X2 to the rotation amount X21, a rotation amount X at a starting point of the second constant velocity period is modified to a rotation amount X31, in which a rotation amount required for the ASF motor 31 accelerating from the velocity V1 to reach the velocity V2 is added to the rotation amount X21.

The rotation amount X 21 is a value corresponding to the distance D for the leading end of the object sheet Q to travel along the guiding surface 24*a* arranged on the separator 25 when the volume level of the remaining sheets Q is high. As shown in FIG. 1, the distance D may be shortened when a larger amount of sheets Q are in the feeder tray 21. Therefore, the rotation amount X21 in the first modified velocity profile is set to be smaller than the rotation amount X2 in the standard velocity profile. Specifically, the rotation amount X21 may be a rotation amount X corresponding to the distance D when the volume level of the remaining sheets Q is at a lowest position within a range of the "high" level: in other words, when the object sheet Q is at a height H closest to the sheets Q in the "medium" level. Based on the volume level of the remaining sheets Q being "high," the ASF controller 40 controls the ASF motor 31 in compliance with the first modified velocity profile.

Meanwhile, based on negative determinations in S210 and S240 that the volume level of the remaining sheets Q is neither "medium" (S220: NO) nor "high" (S240: NO), in other words, based on determination that the volume level of the remaining sheets Q is "low," the main controller 90 proceeds to S260. In S260, the main controller 90 applies a second modified velocity profile, which is a velocity profile designed for the level "low" of the remaining sheets Q, to the ASF controller 40. Further, in S260, the main controller 90 inputs a command to start controlling the ASF motor 31 in compliance with the applied velocity profile. The main controller 90 ends the sheet-feeding process (S110) thereafter.

Figure 5C:
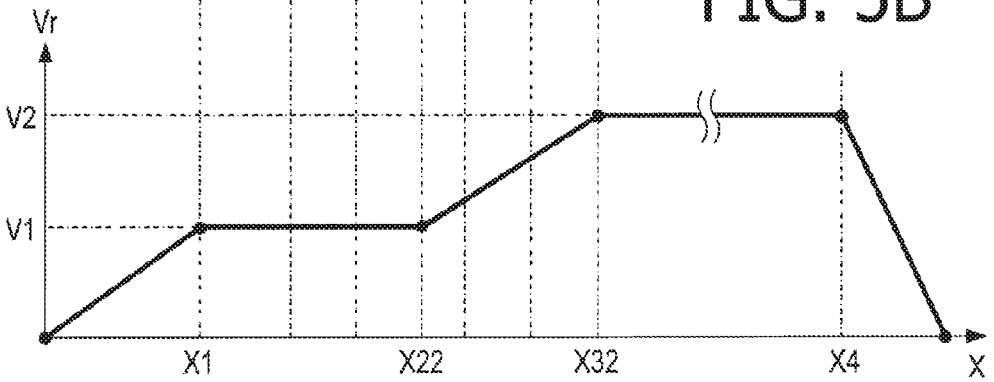

The second modified velocity profile illustrated in FIG. 5C is a velocity profile, in which a rotation amount X at the end of the first constant velocity period is modified from the rotation amount X2 in the standard velocity profile to a rotation amount X22. Further, according to the modification of the rotation amount X2 to the rotation amount X22, a rotation amount X at a starting point of the second constant velocity period is modified to a rotation amount X32, in which a rotation amount required for the ASF motor 31 accelerating from the velocity V1 to reach the velocity V2 is added to the rotation amount X22.

The rotation amount X 22 is a value corresponding to the distance D for the leading end of the sheet Q to travel along the guiding surface 24*a* arranged on the separator 25 when the volume level of the remaining sheets Q is low. Therefore, the rotation amount X22 is set to be greater than the rotation amount X2 in the standard velocity profile. The rotation amount X22 may be a rotation amount X corresponding to the distance D when the volume level of the remaining sheets Q is at a lowest position within a range of the "low" level: in other words, when solely one sheet Q is placed on the feeder tray 21. Based on the volume level of the remaining sheets Q being "low," the ASF controller 40 controls the ASF motor 31 in compliance with the second modified velocity profile.

According to the image forming system 1 of the first embodiment described above, in the sheet-feeding process in S110, the main controller 90 applies the velocity profile corresponding to the volume level of the remaining sheets Q in the sheet feeder tray 21, which may be determined based on the signals input from the angle sensor SN, to the ASF controller 40. The ASF controller 40 calculates the operation amount U corresponding to the ASF motor 31 in compliance with the applied velocity profile. The velocity profile may be designed such that the object sheet Q should be conveyed in a lower velocity to pass over the separator 25 and in a higher velocity after passing over the separator 25.

According to the first embodiment described above, while the distance D for the sheet Q to travel over the separator 25 may vary depending on the volume level of the remaining sheets Q in the feeder tray 21, the velocity profiles for each volume level of the remaining sheets Q are defined according to the distance D. In other words, the velocity profiles for each volume level of the remaining sheets Q are designed to convey the sheet Q speedily in the higher velocity once the sheet Q is conveyed to pass over the separator 25 in the lower velocity.

Therefore, according to the first embodiment, the object sheet Q may be conveyed at the lower velocity over the separator 25 to be separated correctly from the other sheets Q, and still a time period to convey the object sheet Q to an aimed position, e.g., the nipping position NP, may be restrained from being lengthened. In other words, the object sheet Q may be conveyed at the higher velocity to the aimed position. Specifically, the lengths of the first constant velocity periods, or the values of the rotation amounts X2, X21, X22 in each velocity profile, are set to correspond to the values that suit with the respective heights of the object sheet Q at the lowest position within each volume level of the remaining sheets Q. Therefore, according to the first embodiment, by modifying the lengths of the first constant velocity period depending on the volume level of the remaining sheets Q, the ability to separate the object sheet Q from the other sheets Q may be restrained from being lowered.

In this regard, it may be noted that the velocity to convey the sheet Q over the separator 25 is maintained to be lower so that the separating function by the separator 25 should act on the object sheet Q and the other sheets Q for a longer period of time, in other words, the object sheet Q should contact the separator 25 for a longer period of time. Therefore, in the longer period of time to contact the separator 25, the object sheet Q may be correctly separated from the other sheets Q.

Alternatively, the velocity profiles, including the standard velocity profile, the first modified velocity profile, and the second modified velocity profile, may be defined with reference to relationship between time t and the aimed velocities Vr. For example, the targeting module 43 in the ASF controller 40 may measure a length of elapsed time t since the start of the sheet-feeding operation and input a target velocity Vr corresponding to the measured length of the elapsed time t to the controller device 45 in compliance with one of velocity profiles set in the register 41. The velocity profiles may be designed for each volume level of the remaining sheets Q to define the target velocity Vr within the relationship between the time t and the target velocity Vr, which should correspond to the relationship between the rotation amount X and the target velocity Vr illustrated in FIGS. 5A-5C.

According to the first embodiment described above, the image forming system 1 is configured such that the ASF controller 40 should apply the velocity profile, in which the first constant velocity period is shorter when the amount of the remaining sheets Q is larger. In other words, the larger the amount of the remaining sheets Q is, the shorter the first constant velocity period should be. However, the image forming system 1 may not necessarily be configured as such but may be configured to apply varied aimed velocities depending on the volume level of the remaining sheets Q to the ASF controller 40 in the first constant velocity period. For example, the image forming system 1 may be configured to apply a velocity profile, in which the target velocity Vr is lower for the larger volume level of the remaining sheets Q and the target velocity Vr is higher for the smaller level of the remaining sheets Q, to the ASF controller 40 in the first constant velocity period rather than adjusting the length of the first constant velocity period. It may be noted that when the remaining amount of the sheet Q is larger, the distance D for the object sheet Q to contact the separator 25 may be shorter. Therefore, if the target velocity Vr in the first constant velocity period is set at the same velocity V among the different volume levels of the remaining amounts of the sheets Q, the length of the time period, in which the object sheet Q should contact the separator 25, may be shorter when the remaining sheets Q is larger. In contrast, according to the above-mentioned image forming system, in which the target velocity Vr in the first constant velocity period is lower when the remaining sheets Q is larger, the length of the time period, in which the object sheet Q should contact the separator 25, is lengthened even when the amount of the remaining sheets Q is larger. Thereby, with the longer contact between the object sheet Q and the separator 25, the ability to separate the object sheet Q from the other sheets Q may be restrained from being lowered.

Second Embodiment

Next, the image forming apparatus 1 according to a second embodiment will be described below. The image forming apparatus 1 in the second embodiment is configured to be similar to the image forming apparatus 1 in the first embodiment but is different in some aspects, including some of the steps in the sheet-feeding process in S110 (see FIG. 3) and the velocity profiles, which will be described below. In the following description, explanation of items and structures in the image forming apparatus 1 which are identical or equivalent to those described with regard to the image forming apparatus 1 in the first embodiment will be omitted.

Figure 7:
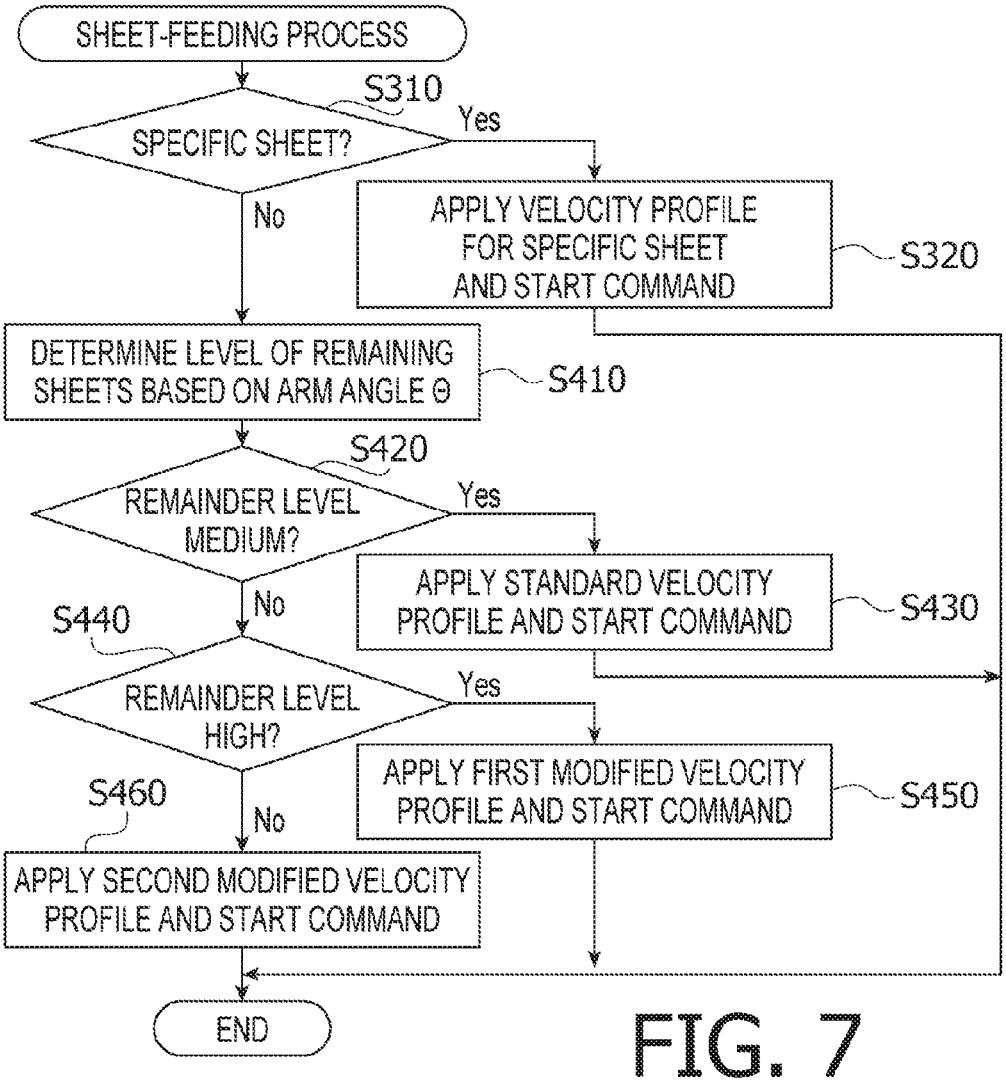
FIG. 7 is a flowchart to illustrate a flow of steps in a sheet-feeding process to be executed by the main controller in the image forming system according to a second embodiment of the present disclosure.

The main controller 90 in the second embodiment conducts in S110 the sheet-feeding process shown in FIG. 7. In the sheet-feeding process, in S310, the main controller 90 determines whether a type of the sheet, which is indicated in sheet-type data received from the external device along with the printable data, is a specific type. The sheet-type data indicates a type of the sheets Q, and the specific type of sheet may be, for example, gloss paper. In the following description, a sheet in the specific type may be referred to as "specific sheet."

Based on affirmative determination that the type of the sheet is the specific type (S310: YES), the main controller 90 proceeds to S320. In S320, the main controller 90 applies a velocity profile for the specific sheet to the ASF controller 40 and inputs a command to the ASF controller 40 to start controlling the ASF motor 31 in compliance with the applied velocity profile. Thereafter, the main controller 90 ends the sheet-feeding process (S110).

Figure 8:
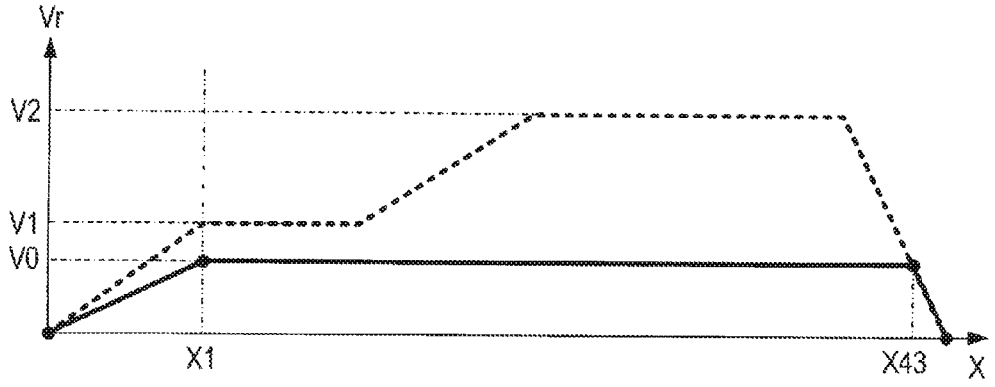
FIG. 8 is a graph to illustrate a velocity profile for a specific type of sheet in the image forming system according to the first embodiment of the present disclosure.

The velocity profile for the specific sheet is a unit of data, defining a relationship between the rotation amount X and the target velocity Vr, which is indicated in a solid thick line in FIG. 8. As seen in FIG. 8, the velocity profile for the specific sheet defines a constant velocity period, in which the target velocity Vr is maintained constant, between an acceleration period and a reduction period. A target velocity V0 in the constant velocity period is a velocity V, which is preferable for the object sheet Q to be separated from the other sheets Q in the lower layer and conveyed to the nipping position NP correctly. Meanwhile, a broken line in FIG. 8 indicates transition of the target velocity Vr in the standard velocity profile shown in FIG. 5A, which is to be compared with the solid thick line.

When an image is formed on a sheet Q of gloss paper being the specific sheet, the user may often expect the image should be formed in a higher quality. Therefore, the sheet Q should be conveyed to the nipping position in a less skewed orientation with a less amount of conveyance error. Thus, while the image to be formed on the gloss paper in the higher quality, a feeding velocity to feed the sheet Q may be lowered, and the lowered feeding velocity may largely affect entire throughput of the image forming operation until the image is completely formed. Therefore, in the second embodiment, the velocity profile for the specific sheet, in which the sheet Q is conveyed at a lower velocity, compared to a velocity profile for the sheet Q which is not the specific sheet. A rotation amount X1 shown in FIG. 8 is equal to the rotation amount X1 in the standard velocity profile. A rotation amount X43 is set at a point corresponding to a distance required for the ASF motor 31 reducing the velocity and stop rotating.

In S310, based on negative determination that the type of the sheet is not the specific type (S310: NO), the main controller 90 proceeds to S410, in which, similarly to S210, the main controller 90 determines a volume level of the remaining sheets Q based on the arm angle Θ. In S420, based on affirmative determination that the volume level of the remaining sheets Q is "medium" (S420: YES), the main controller 90 proceeds to S430. In S430, similarly to S230 in the first embodiment, the main controller 90 applies the standard velocity profile shown in FIG. 5A to the ASF controller 40 and inputs a command to the ASF controller 40 to start controlling the ASF motor 31 in compliance with the applied velocity profile. Thereafter, the main controller 90 ends the sheet-feeding process (S110).

Meanwhile, based on determinations in S420 and S440 that the volume level of the remaining sheets Q is not "medium" (S420: NO) but "high" (S440: YES), the main controller 90 proceeds to S450. In S450, the main controller 90 applies a first modified velocity profile, which is a velocity profile illustrated in FIG. 9A designed for the level "high" of the remaining sheets Q, to the ASF controller 40. Further, in S450, the main controller 90 inputs a command to start controlling the ASF motor 31 in compliance with the applied velocity profile. The main controller 90 ends the sheet-feeding process (S110) thereafter.

Figure 9A:
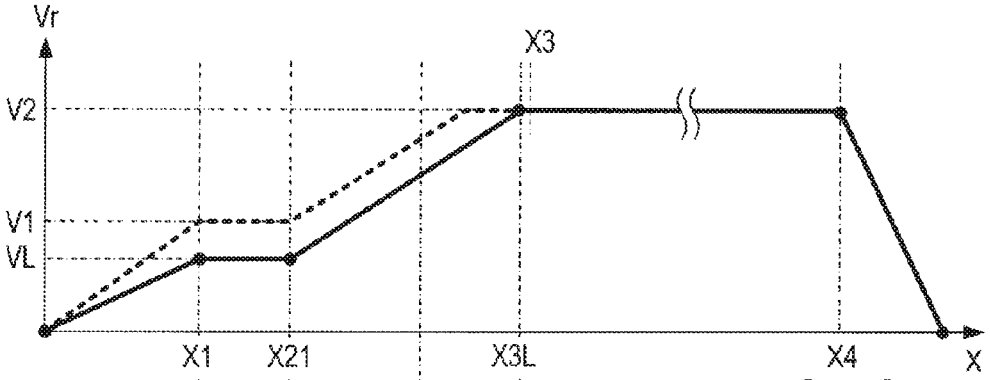
FIGS. 9A and 9B are graphs to illustrate a first modified velocity profile and a second modified velocity profile respectively in the image forming system according to the second embodiment of the present disclosure.

A solid thick line in FIG. 9A illustrates transition of the target velocity Vr in compliance with the first modified velocity profile to be applied to the ASF controller 40. A broken line in FIG. 9A illustrates the transition of the target velocity Vr in compliance with the first modified velocity profile to be applied to the ASF controller 40 in the first embodiment (see FIG. 5B), which is to be compared with the solid thick line.

As seen from the comparison with the broken line, the first modified velocity profile in the second embodiment defines the target velocity Vr in the first constant velocity period to be a target velocity VL, which is lower than the target velocity V1 in the first embodiment. Further, the first modified velocity profile in the second embodiment defines the target velocity Vr in the second constant velocity period to be equal to the target velocity V2 in the first embodiment.

The rotation amounts X1, X21 shown in FIG. 9A are equal to the rotation amounts X1, X21 shown in FIG. 5B, respectively. Therefore, in the second embodiment, when the volume level of the remaining sheets Q is high, the ASF motor 31 is driven to rotate at a lower velocity VL, which is lower than the velocity V1 (VL<V1) in the first constant velocity period in the first embodiment, in the first constant velocity period until the sheet Q passes over the separator 25. Thus, the sheet Q passes over the separator 25 at the velocity VL which is lower than the velocity V1 in the first embodiment.

When the volume level of the remaining sheets Q is high, as mentioned above, the distance D for the object sheet Q to travel along the separator 25 is shorter than the distance D for the sheet Q when the volume level of remaining sheets Q is low. Therefore, while the shorter distance D may reduce the separating ability of the separator D, in the second embodiment, the first modified velocity profile, in which the sheet Q may be conveyed along the separator 25 more slowly, is designed so that the separating ability of the separator 25 may be restrained from being lowered.

If the target velocity VL being the target velocity Vr in the first constant velocity period is lower, the ASF motor 31 may require longer time to accelerate the velocity VL to the velocity V2. Therefore, a rotation amount X at a starting point of the second constant velocity period in the first modified velocity profile is modified to a rotation amount X3L, in which a rotation amount required for the ASF motor 31 accelerating from the velocity VL to reach the velocity V2 is added to the rotation amount X21. Thus, based on the volume level of the remaining sheets Q being "high," the ASF controller 40 controls the ASF motor 31 in compliance with the first modified velocity profile.

Meanwhile, based on the volume level of the remaining sheets Q determined in S410 (see FIG. 7) being "low" (S440: NO), the main controller 90 proceeds to S460. In S460, the main controller 90 applies a second modified velocity profile, which is a velocity profile designed for the level "low" of the remaining sheets Q, in the ASF controller 40. Further, in S460, the main controller 90 inputs a command to start controlling the ASF motor 31 in compliance with the applied velocity profile. The main controller 90 ends the sheet-feeding process (S110) thereafter.

Figure 9B:
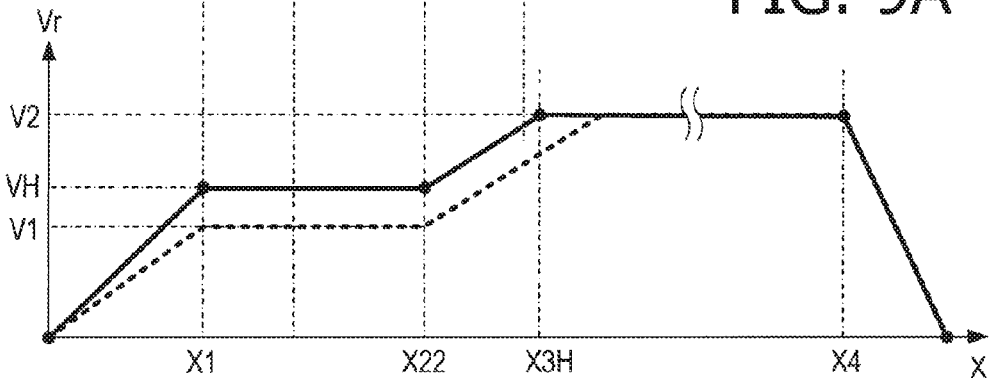

A solid thick line in FIG. 9B illustrates transition of the target velocity Vr in compliance with the second modified velocity profile to be applied to the ASF controller 40. A broken line in FIG. 9B indicates the transition of the target velocity Vr in compliance with the first modified velocity profile to be applied to the ASF controller 40 in the first embodiment (see FIG. 5B), which is to be compared with target velocity Vr in the solid thick line.

As seen from the comparison with the broken line, the second modified velocity profile in the second embodiment defines the target velocity Vr in the first constant velocity period to be a target velocity VH, which is higher than the target velocity V1 in the first embodiment. Further, the second modified velocity profile in the second embodiment defines the target velocity Vr in the second constant velocity period to be equal to the target velocity V2 in the first embodiment. Meanwhile, the target velocity VH in the first constant velocity period is defined to be a lower value than the target velocity V2 in the second constant velocity period.

The rotation amounts X1, X22 shown in FIG. 9B are equal to the rotation amounts X1, X22 shown in FIG. 5C, respectively. Therefore, in the second embodiment, when the volume level of the remaining sheets Q is low, the ASF motor 31 is driven to rotate at a higher velocity VH, which is higher than the velocity V1 (VH>V1) in the first constant velocity period in the first embodiment, in the first constant velocity period until the sheet Q passes over the separator 25. Thus, the sheet Q passes over the separator 25 at the velocity VH higher than the velocity V1 in the first embodiment.

When the volume level of the remaining sheets Q is low, as mentioned above, the distance D for the object sheet Q to travel along the separator 25 is longer than the distance D for the sheet Q when the volume level of remaining sheets Q is high. When the distance D is longer, the separating ability of the separator 25 to separate the object sheet Q from the other sheets Q may be secured. Therefore, in the second embodiment, the second modified velocity profile, in which the sheet Q may be conveyed more speedily along the separator 25, is designed so that the velocity to feed the object sheet Q may be increased and the sheet Q may be conveyed efficiently.

A rotation amount X at a starting point of the second constant velocity period in the second modified velocity profile is modified to a rotation amount X3H, in which a rotation amount required for the ASF motor 31 accelerating from the velocity VH to reach the velocity V2 is added to the rotation amount X22. Thus, based on the volume level of the remaining sheets Q being "low," the ASF controller 40 controls the ASF motor 31 in compliance with the second modified velocity profile.

According to the image forming system 1 in the second embodiment described above, the target velocity Vr, at which the sheet Q should be conveyed over the separator 25, is changed depending on the remaining sheets Q in consideration of the distance D, which is variable depending on the remaining sheets Q.

Therefore, according to the second embodiment, the main controller 90 applies the target velocity Vr for the first constant velocity period, which should be lower when the amount of the remaining sheets Q is larger and higher when the amount of the remaining sheets Q is smaller. In particular, the target velocity Vr, among the target velocity VN for the remainder sheet level low, the target velocity V1 for the remainder sheet level medium, and the target velocity VL for the remainder sheet level high, is applied. Meanwhile, in the second constant velocity period, the main controller 90 applies the invariable target velocity V2, irrespectively of the volume level of the remaining sheets Q. Therefore, according to the second embodiment, the separating ability of the separator 25 to separate the object sheet Q from the other sheets Q may be maintained, and the sheets Q may be conveyed efficiently while the influence of the variable volume levels of the remaining sheets Q may be lessened.

Further, according to the second embodiment, the main controller 90 determines in S310 whether the type of the sheet Q indicated in the sheet-type data, which is received together with the printable data from the external device, is the specific type. Based on the affirmative determination (S310: YES) that the type of the sheet Q is the specific type, in S320, the main controller 90 applies the velocity profile for the specific sheet, which is the velocity profile irrespective of the volume level of the remaining sheets Q and includes the single constant velocity period, to the ASF controller 40. In this regard, forming an image on gloss paper, which may be the sheet Q of the specified type, may require accurate conveyance, and it may be preferable that the sheet Q should be conveyed at a lower velocity even after passing over the separator 25. Thus, according to the second embodiment, the sheet-feeding operation to feed the sheet Q may be controlled preferably according to the type of the sheet Q.

Although examples of carrying out the present disclosure have been described, those skilled in the art will appreciate that there are numerous variations and permutations of the sheet conveyor and the image forming system that fall within the spirit and scope of the disclosure as set forth in the appended claims.

Figure 10:
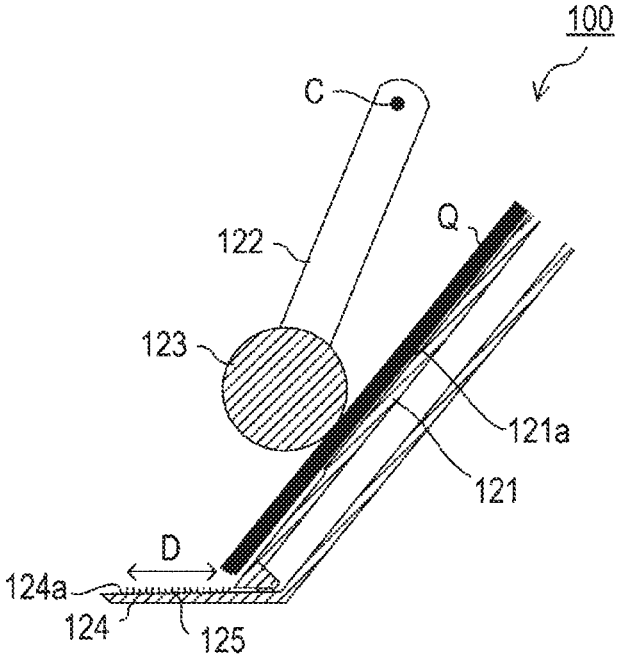
FIG. 10 is a partial view of a sheet feeder in a different example of the sheet conveyer according to the embodiment of the present disclosure.

For example, as shown in FIG. 10, the present disclosure may be applied to an image forming system 100, in which a guide 124 with a guiding surface 124*a* lying horizontally may be disposed in adjacent to a sheet-feeder tray 121 while the sheet-feeder tray 121 has an inclined bottom surface 121*a*. The guiding surface 124*a* may spread along a predetermined direction, which contains direction components of the conveying direction to convey the object sheet Q by a feeder roller 123 and a stacking direction of the sheets Q to be stacked on a sheet-feeder tray 121. In other words, the guiding surface 124*a* may spread in parallel with the horizontal direction. According to the image forming system 100, a separator 125 may be arranged on the guiding surface 124*a* along the predetermined direction to protrude in the stacking direction from the guiding surface 124*a*.

Meanwhile, the feeder roller 123 may be supported rotatably by an arm 122 to contact the topmost one of the sheets Q in the sheet-feeder tray 121. According to the rotation of the feeder roller 123, which may be clockwise rotation in FIG. 10, the sheet Q contacting the feeder roller 123 may pass over the separator 125 on the guiding surface 124*a*. In order to accurately separate the topmost sheet Q from the other sheets Q and maintain the efficiency to convey the sheet Q, the velocity profiles which are designed for each volume level of the remaining sheets Q may likewise be applied to the image forming system 100.

It is to be understood that the subject matter defined in the appended claims is not necessarily limited to the specific features or act described above. Rather, the specific features and acts described above are disclosed as example forms of implementing the claims.

What is claimed is:

1. A sheet feeder, comprising:

a tray;

a feeder roller configured to contact an object sheet being a topmost one of a plurality of sheets in a stack in the tray to feed the object sheet in a feeding direction by rotating;

a guide disposed downstream of the feeder roller in the feeding direction to adjoin the tray, the guide comprising a guiding surface extending from a bottom of the tray in a predetermined direction, the predetermined direction containing a direction of the sheets to be stacked in the tray and the feeding direction, and the guiding surface being arranged to incline at an obtuse angle with respect to the object sheet fed to contact the guiding surface by the feeder roller;

a separator arranged on the guide to protrude from the guiding surface toward a space in the tray to accommodate the plurality of sheets to align with the predetermined direction, the separator being configured to separate the object sheet fed by the rotation of the feeder roller from the other of the plurality of sheets;

a motor configured to drive the feeder roller to rotate;

a controller configured to control the motor; and a sensor configured to input a signal corresponding to a remaining volume of the plurality of sheets in the tray to the controller, wherein the controller is configured to:

based on the signal input by the sensor, determine the remaining volume of the plurality of sheets in the tray;

based on the determined remaining volume of the plurality of sheets, generate a velocity profile defining a target velocity to feed the topmost sheet from a start to an end of a sheet-feeding operation, so that the topmost sheet is fed at a lower velocity in a first period than a velocity in a second period, the first period being a length of time, in which a driving amount since the start of the sheet-feeding operation reaches an amount corresponding to a moved amount for a leading end of the topmost sheet in the feeding direction to pass over the separator, the driving amount being one of a length of driving time and a rotation amount of the motor, the second period being later than the first period, in the sheet-feeding operation, the velocity profile being generated to define at least one of a length of the first period to be shorter as the determined remaining volume of the plurality of sheets is larger and the target velocity in the first period of the velocity profile to be lower as the determined remaining volume of the plurality of sheets is larger; and control the motor in compliance with the generated velocity profile.

2. The sheet feeder according to claim 1, wherein the controller is configured to set the target velocity in the second period at a predetermined target velocity irrespective of the remaining volume of the plurality of sheets.

3. The sheet feeder according to claim 1, wherein, in the first period, the controller is configured to control the motor so that the object sheet is fed at the target velocity for the first period, and in the second period, the controller is configured to control the motor so that the object sheet is fed at the target velocity for the second period being higher than the target velocity for the first period.

4. The sheet feeder according to claim 1, wherein the controller is configured to determine one of a plurality of predetermined ranges that corresponds to the remaining volume of the plurality of sheets; and wherein the at least one of the length of the first period and the target velocity modified for the first period is preset to each of the plurality of predetermined ranges.

5. The sheet feeder according to claim 1, wherein the controller is configured to determine a type of the object sheet;

wherein, based on determination that the type of the object sheet is a first type, the controller is configured to generate a first velocity profile, the first velocity profile defining the target velocity in the first period to be constant and the target velocity in the second period to be constant, the target velocity in the first period being lower than the target velocity in the second period, and the controller is configured to control the motor in compliance with the first velocity profile; and wherein, based on determination that the type of the object sheet is a second type which is different from the first type, the controller is configured to generate a second velocity profile, the second velocity profile defining a single constant velocity period in which the target velocity is constant and irrespective of the remaining volume of the plurality of sheets, and the controller is configured to control the motor in compliance with the second velocity profile.

6. An image forming system, comprising:

a sheet feeder, the sheet feeder comprising:

a tray;

a feeder roller configured to contact an object sheet being a topmost one of a plurality of sheets in a stack in the tray to feed the object sheet in a feeding direction by rotating;

a guide disposed downstream of the feeder roller in the feeding direction to adjoin the tray, the guide comprising a guiding surface extending from a bottom of the tray in a predetermined direction, the predetermined direction containing a direction of the sheets to be stacked in the tray and the feeding direction, and the guiding surface being arranged to incline at an obtuse angle with respect to the object sheet fed to contact the guiding surface by the feeder roller;

a separator arranged on the guide to protrude from the guiding surface toward a space in the tray to accommodate the plurality of sheets to align with the predetermined direction, the separator being configured to separate the object sheet fed by the rotation of the feeder roller from the other of the plurality of sheets;

a motor configured to drive the feeder roller to rotate;

a controller configured to control the motor; and a sensor configured to input a signal corresponding to a remaining volume of the plurality of sheets in the tray to the controller, and an image forming apparatus configured to form an image on the object sheet fed by the sheet feeder, wherein the controller of the sheet feeder is configured to:

based on the signal input by the sensor, determine the remaining volume of the plurality of sheets in the tray;

based on the determined remaining volume of the plurality of sheets, generate a velocity profile defining a target velocity to feed the object sheet from a start to an end of a sheet-feeding operation, so that the object sheet is fed at a lower velocity in a first period than a velocity in a second period, the first period being a length of time, in which a driving amount since the start of the sheet-feeding operation reaches an amount corresponding to a moved amount for a leading end of the object sheet in the feeding direction to pass over the separator, the driving amount being one of a length of driving time and a rotation amount of the motor, the second period being later than the first period, in the sheet-feeding operation the velocity profile being generated to define at least one of a length of the first period to be shorter as the determined remaining volume of the plurality of sheets is larger and the target velocity in the first period of the velocity profile to be lower as the determined remaining volume of the plurality of sheets is larger; and control the motor in compliance with the generated velocity profile.

7. A method adapted to be implemented on a controller coupled with a sheet feeder, the method comprising:

based on a signal input to the controller by a sensor of the sheet feeder, determining a remaining volume of a plurality of sheets stacked in a tray of the sheet feeder;

based on the determined remaining volume of the plurality of sheets, generating a velocity profile defining a target velocity to feed a topmost sheet which is one of the plurality of sheets stacked in the tray from a start to an end of a sheet-feeding operation, so that the topmost sheet is fed at a lower velocity in a first period than a velocity in a second period, the first period being a length of time, in which a driving amount since the start of the sheet-feeding operation reaches an amount corresponding to a moved amount for a leading end of the topmost sheet in the feeding direction to pass over the separator, the driving amount being one of a length of driving time and a rotation amount of the motor, the second period being later than the first period, in the sheet-feeding operation generating the velocity profile so that at least one of a length of the first period is defined to be shorter as the determined remaining volume of the plurality of sheets is larger and the target velocity in the first period of the velocity profile is defined to be lower as the determined remaining volume of the plurality of sheets is larger; and controlling a motor in the sheet feeder in compliance with the generated velocity profile.

8. A sheet feeder, comprising:

a tray;

a feeder roller configured to contact an object sheet being a topmost one of a plurality of sheets in a stack in the tray to feed the object sheet in a feeding direction by rotating;

a guide disposed downstream of the feeder roller in the feeding direction to adjoin the tray, the guide comprising a guiding surface extending from a bottom of the tray in a predetermined direction, the predetermined direction containing a direction of the sheets to be stacked in the tray and the feeding direction, and the guiding surface being arranged to incline at an obtuse angle with respect to the object sheet fed to contact the guiding surface by the feeder roller;

a separator arranged on the guide to protrude from the guiding surface toward a space in the tray to accommodate the plurality of sheets to align with the predetermined direction, the separator being configured to separate the object sheet fed by the rotation of the feeder roller from the other of the plurality of sheets;

a motor configured to drive the feeder roller to rotate;

a controller configured to control the motor; and a sensor configured to input a signal corresponding to a remaining volume of the plurality of sheets in the tray to the controller, wherein the controller is configured to:

based on the signal input by the sensor, determine the remaining volume of the plurality of sheets in the tray;

generate a velocity profile defining a target velocity to feed the topmost sheet from a start to an end of a sheet-feeding operation, so that the topmost sheet is fed at a lower velocity in a first period than a velocity in a second period, the second period being later than the first period, in the sheet-feeding operation;

based on the determined remaining volume of the plurality of sheets, modify at least one of a length of the first period and the target velocity in the first period of the velocity profile; and after a modification of the velocity profile, control the motor in compliance with the modified velocity profile, wherein the controller is configured to determine a type of the object sheet;

wherein, based on determination that the type of the object sheet is a first type, the controller is configured to generate a first velocity profile, the first velocity profile defining the target velocity in the first period to be constant and the target velocity in the second period to be constant, the target velocity in the first period being lower than the target velocity in the second period, and the controller is configured to control the motor in compliance with the first velocity profile; and wherein, based on determination that the type of the object sheet is a second type which is different from the first type, the controller is configured to generate a second velocity profile, the second velocity profile defining a single constant velocity period in which the target velocity is constant and irrespective of the remaining volume of the plurality of sheets, and the controller is configured to control the motor in compliance with the second velocity profile.

* * * * *